US008632414B1

(12) United States Patent
Rippberger

(10) Patent No.: US 8,632,414 B1
(45) Date of Patent: Jan. 21, 2014

(54) FEEDBACK-BASED GOLF SWING TRAINING AID

(71) Applicant: Charles Albert Rippberger, Albuquerque, NM (US)

(72) Inventor: Charles Albert Rippberger, Albuquerque, NM (US)

( * ) Notice: Subject to any disclaimer, the term of this patent is extended or adjusted under 35 U.S.C. 154(b) by 0 days.

(21) Appl. No.: 13/840,622

(22) Filed: Mar. 15, 2013

Related U.S. Application Data

(60) Provisional application No. 61/698,134, filed on Sep. 7, 2012.

(51) Int. Cl.
*A63B 69/36* (2006.01)

(52) U.S. Cl.
USPC ..... 473/208; 212/226; 212/409

(58) Field of Classification Search
USPC ..... 473/205, 206, 207, 208, 226, 229, 266, 473/274, 275, 409
See application file for complete search history.

(56) References Cited

U.S. PATENT DOCUMENTS

| | | | | |
|---|---|---|---|---|
| 3,442,513 | A * | 5/1969 | Fisher et al. | 473/208 |
| 5,893,803 | A * | 4/1999 | Leadbetter et al. | 473/206 |
| 6,783,464 | B1 * | 8/2004 | Romano | 473/208 |
| 6,939,246 | B1 * | 9/2005 | Minichino et al. | 473/274 |
| 2001/0046904 | A1 * | 11/2001 | Arvanitis, Jr. | 473/208 |

* cited by examiner

*Primary Examiner* — Nini Legesse
(74) *Attorney, Agent, or Firm* — Bauman Dow & León PC; Alberto A. León, Esq.

(57) ABSTRACT

A golf swing training and aid device that provides feedback to the user that allows correction of golf swing flaws. The device comprises a neck collar attached to an elastic feedback means, such as a bungee cord. The feedback means attaches to a gold club through the vent hole of the golf club grip. When a user keeps constant tension on the feedback means throughout the swing, the device promotes or encourages: a more comfortable and effective grip; a stance and posture more conducive to produce good golf shots and to preserve balance; a wider and stronger shoulder turn; a parallel position of the club relative to the shoulders at the top of the backswing; a more efficient position of the club at the start of the downswing; a stronger impact; a vertical follow through; and a balanced swing finish.

13 Claims, 4 Drawing Sheets

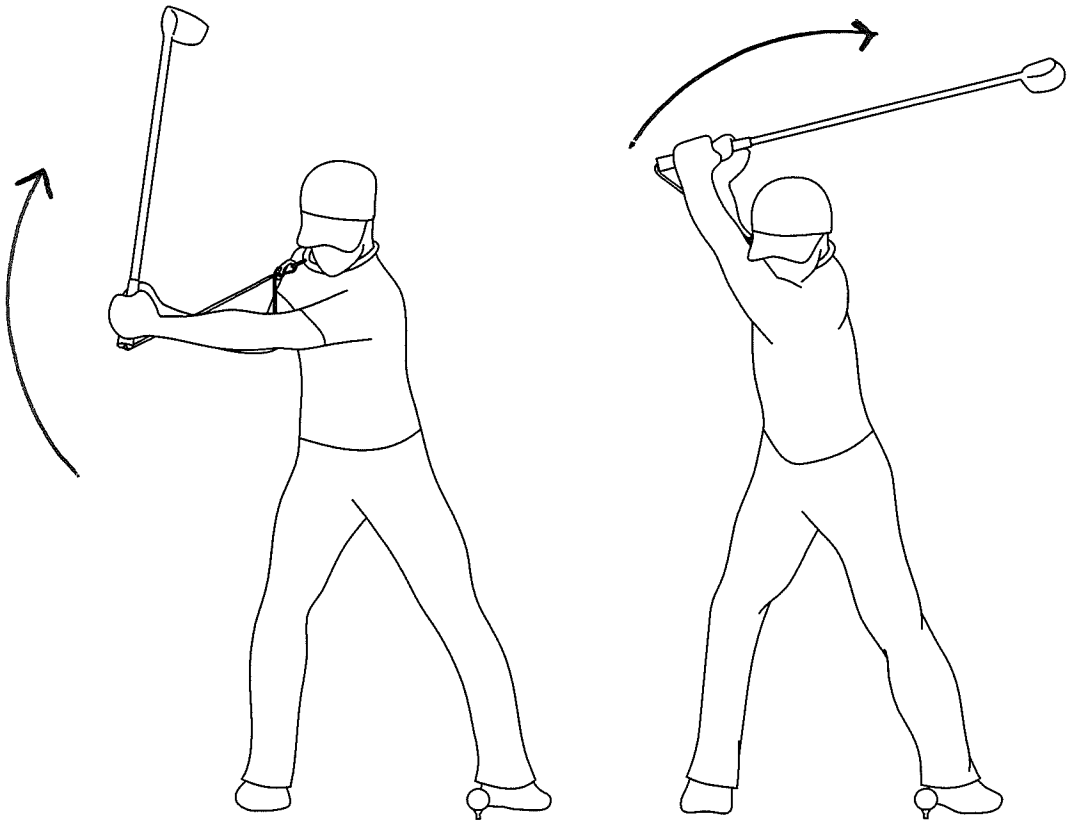
FIG. 2
FIG. 3
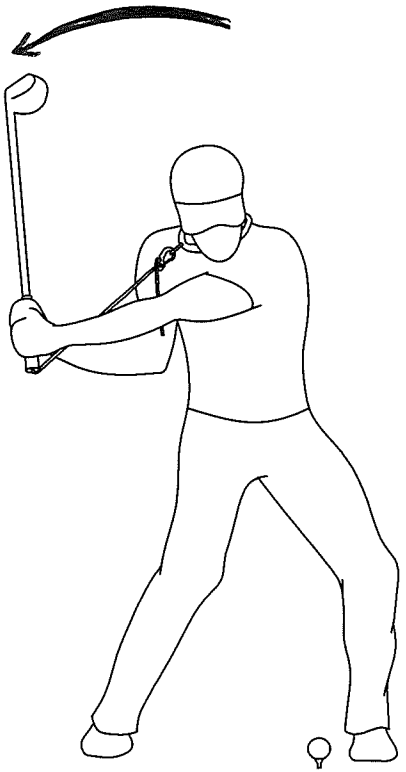
FIG. 4

FEEDBACK-BASED GOLF SWING TRAINING AID

CROSS-REFERENCE TO RELATED APPLICATIONS

Provisional Patent Application No. 61/698,134

STATEMENT REGARDING FEDERALLY SPONSORED RESEARCH AND DEVELOPMENT

Non-applicable

THE NAMES OF THE PARTIES TO A JOINT RESEARCH AGREEMENT

Non-applicable

INCORPORATION-BY-REFERENCE OF MATERIAL SUBMITTED ON A COMPACT DISC

Non-applicable

BACKGROUND OF THE INVENTION

1. Field of the Invention

The present invention generally relates to sports training aids. More particularly it relates to devices useful to improve a golfer's overall golf swing and golf game. Even more particularly, the present invention relates to an apparatus capable of enhancing a golfer's grip, stance and posture and therefore the overall swing.

2. Description of the Related Art Including Information Disclosed Under 37 CFR 1.97 and 37 CFR 1.98

The following description of the art related to the present invention refers to a number of publications and references. Discussion of such publications herein is given to provide a more complete background of the principles related to the present invention and is not to be construed as an admission that such publications are necessarily prior art for patentability determination purposes.

The game of golf, essentially as we know it today, was invented in 15$^{th}$ Century Scotland. The first "13 Rules of Golf" were established in 1774. Since golf's inception, golfers have been trying to improve how to play the game, how to lower their score and more specifically, how to swing the golf club correctly resulting in maximized impact with the golf ball.

It is a well-known fact, proven by numerous tests, that movements of the body allow the golf swing to properly convey the desired power to propel the golf ball in a predetermined direction, distance, height and trajectory. Proficient golfers are very aware of the necessary body movements and sequence. They also usually have sound mechanics when performing full or partial (short game) swings. In short, sound golfing skills require sound fundamentals.

Unfortunately for many aspiring golfers, the necessary fundamental body movements, sequence and mechanics that a good golfer must perform in order to hit the ball consistently are too numerous to remember. Accordingly, the golf swing becomes taxing, vexing, and its seemingly and preceived complex execution takes away from the game's enjoyment.

Because of the level of difficulty required to play with at least a moderate level of proficiency, many different aid devices, sold as swing trainers, have been developed and marketed over the years. The most effective golf swing trainers are designed to give the golfer feedback. In this context, feedback is information the body receives from the swing aid that can be used to execute a more effective golf swing. Feedback can be visual, verbal, and most importantly experiential. The player needs to experience and feel the proper swing.

A proper full golf swing has many different fundamental components. There appears to be general agreement that a golf swing comprises the fundamental elements related to the: (1) way the player grips the club, (2) player's stance and posture, (3) upswing or first part of the swing (from the address position to the top of the backswing), and (4) downswing or the second part of the swing (from the top of the backswing to the finish and follow-through).

Improving golfers' movements, including the timing of their swing's sequential elements, has given rise to numerous golf swing aids or training apparatuses and methods. Most of the devices and methods in the market are geared to reducing and/or eliminating variables and deviations inherent in the golf swing. Some of the most commonly recognized swing flaws, or flawed deviations from the correct mechanics of an effective golf swing, relate to: (1) grip, (2) stance and posture, (3) ball position and alignment relative to the players feet or to the target, (4) take away, (5) hip and shoulder turn during the backswing and downswing, (6) position of the body at impact, (7) follow through, (8) timing and tempo, (9) position at finish, and (10) overall balance.

US. Patent Application Ser. No. 2011/0165955 by Moore discloses and claims a golf swing aid device of limited utility. The device disclosed in the Moore application only attempts to promote a better turn and swing plane, which are sub-elements of one of the four fundamental elements of the golf swing. Moreover, that device is not easy to use and the movement it elicits is not natural or that helpful. For those reasons, that device appears to provide some feedback, but not necessarily the correct feedback necessary to enhance a golfer's swing.

An effective swing training device should, at a minimum: (1) help the golfer become physically and visually aware of the movement in the body required to execute a proper swing, and (2) strive to eliminate undesirable swing variations. A useful swing aid and training device can attain both of those goals by using effective feedback to promote proper golf swing mechanics, personalized to each user of the device.

The present invention illustrates the shortcomings of several of the devices in the market relative to their ability to teach and develop proper golf swing mechanics.

BRIEF SUMMARY OF THE INVENTION

Objects, advantages and novel features, and further scope of applicability of the present invention will be set forth in part in the detailed description to follow, taken in conjunction with the accompanying drawings. The objects, advantages and novel features, and further scope of applicability of the present invention will become apparent to those skilled in the art upon examination of the following, or may be learned by practice of the invention. The objects and advantages of the invention may be realized and attained by means of the instrumentalities and combinations particularly pointed out in the appended claims.

The overall objective of the present invention is to provide a golf swing training and aid device capable of helping a user improve his or her golf swing through the learning of, feedback and repetition of more efficient swing mechanics. The swing training and aid device of the present invention can be used by right or left handed men, women and juniors. The device can be swung indoors, outdoors, and the user can actually practice by hitting golf balls on the driving range with the device.

Among the more specific and salient objects of the invention disclosed and claimed in the present application are to provide a golf swing training and aid device that promotes or encourages:

1. a more comfortable and more effective grip;
2. a stance and posture more conducive to produce good golf shots and to preserve the player's balance;
3. a one-piece take away;
4. a wider and stronger shoulder turn which results in more power;
5. a parallel position of the club relative to the shoulders at the top of the backswing;
6. a more efficient position of the club and club head at the start of the downswing thus promoting an "in-out" swing trajectory and minimizing the possibility of "casting" (out-in swing trajectory) of the club with the hands or shoulders;
7. an increasingly stronger (more club head speed) impact position;
8. a vertical follow through;
9. more efficient swing, tempo and timing; and
10. a balanced swing finish.

The golf swing training and aid devices of the prior art usually only affect a few of the factors above. In fact, many of those devices are cumbersome, uncomfortable and not very easy to use. Some golf swing training and aid devices do not allow the user to actually hit golf balls in real practice situations. Most of those devices do not provide educational visual and "feel" feedback to the user. Applicants are not aware of a single golf swing training and aid device of the prior art that can be used for aiding the user's full and short-game swings.

The golf swing training and aid device disclosed and claimed in this application works by providing feedback to the user that allows correction of golf swing flaws. It also trains the "golfing muscles" to move the user's body with the necessary timing, increased strength and efficiency, and pathway necessary to produce a more powerful and efficient golf swing, which in turn results in a more desirable golf shot. The device of the present application can be used to promote a significant increase in club head speed, which translates to more powerful shots, and to promote the correct club path and swing while executing short shots (30 yards and below). In short, consistent and proper use of the golf swing training and aid device of this application allow the "golf muscles" to become retrained to swing any golf club in the most efficient and correct manner possible. By doing so, the device of this invention reduces or eliminates the most common swing flaws such as: (1) an overly strong or weak grip, (2) incorrect or inefficient stance and posture, (3) a quick or disconnected take-away, (4) shorter than required shoulder turn, (5) overly flat or shortened backswing, (6) over-swinging at the top of the backswing, (7) casting the club with either the hands or right shoulder as the golfer starts the down swing, (8) releasing lag too soon in the down swing, (9) overly bent left elbow (also known as "chicken wing") impact position, (10) less than required or no extension in follow-through, and (11) diminished balance at the finishing position.

Further objects and advantages of the invention will become apparent from the following description and claims and from the accompanying drawings.

BRIEF DESCRIPTION OF THE SEVERAL VIEW OF THE DRAWINGS

The accompanying drawings, which are incorporated into and form a part of the specification, illustrate an embodiment of the present invention and, together with the description, serve to explain the principles of the invention. The drawings are only for the purpose of illustrating a preferred embodiment of the invention and are not to be construed as limiting the invention.

FIG. 2 illustrates a user utilizing the present invention in the middle of the backswing.

FIG. 3 illustrates a user utilizing the present invention in the top of the swing.

FIG. 4 illustrates a user utilizing the present invention in the middle of the downswing.

FIG. 6 illustrates a user utilizing the present invention in the beginning of the follow through.

DETAILED DESCRIPTION OF THE INVENTION

Figure 6:
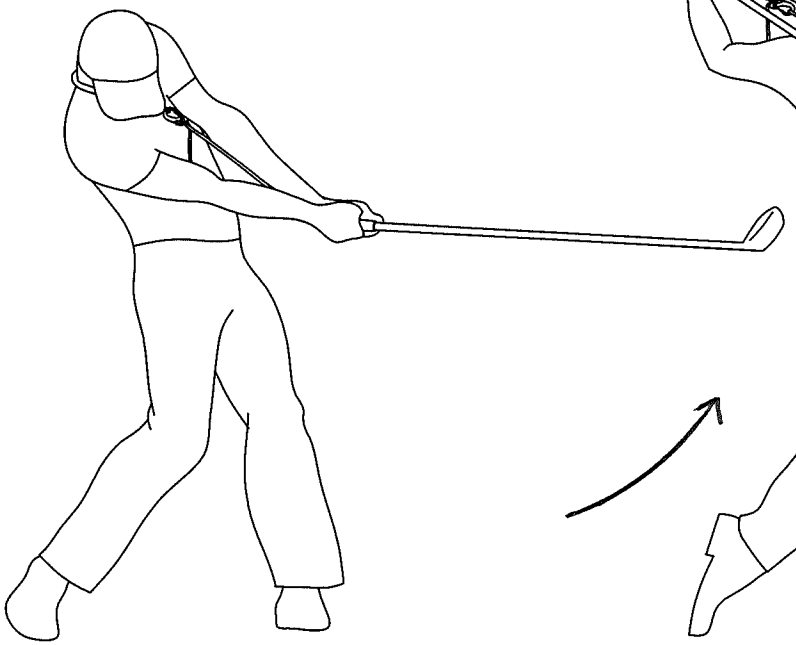

The device of the present invention is illustrated in FIG. 6. The device comprises an ergonomically designed and fully adjustable neck collar (1), which further comprises two ends (14) and a center portion (15). The collar may be any suitable material having sufficient strength to keep the collar comfortably secured on the user's neck via an attachment means (2) selected from the group consisting of Velcro, button and eye combinations, buckles, fasteners and magnets. The attachment means (2) is affixed to one or both ends (14) of the collar. The neck collar comprises a receiving means (3) firmly attached into the center (15) of the collar. In the preferred embodiment of the invention, the receiving means (3) is selected from a group consisting of both plastic and metal "D" ring, carabiner, grommet, loop and O-ring, capable of receiving a detachable engagement means (4). Other embodiments of the receiving means could be any durable circular structure with an opening in the middle.

The detachable engagement means (4) comprises an engagement end (10) and a receiving end (11). The engagement end interfaces with the receiving means (3) and the receiving end interfaces with the feedback means (5). In the preferred embodiment of the invention, the detachable engagement means (4) comprises an adjustable plastic hook. However, the engagement means can be selected from the group consisting of metal or plastic hook, carabiner, snap hook, swivel snap, bolt snap, cam buckle, spring buckle and ratchet buckle. The detachable engagement means (4) is further firmly attached through the receiving end (11) to a feedback means (5). In the preferred embodiment of the invention, the feedback means (5) comprises a graduated bungee cord or equivalent elastic, resistant and adjustable elongated component. The feedback means (5) is graduated (17) and capable of being secured at different levels through the receiving end (11) so that each user can ascertain the number in the graduated feedback means (5) that provides maximum feedback.

The feedback means (5) comprises a top end (12) attachable to the receiving end (11) of the detachable engagement means and a bottom end (13) firmly attached to a golf club grip (6) through a vent hole (7) commonly found in all commercial golf club grips. The golf club grip (6) is attached to the golf club shaft (8) with glue and double-sided tape, which is the attachment means in most, if not all, commercially available golf clubs. The shaft (8) is securely attached to a golf club head (9) using resin epoxy, which, again, is the attachment means in most, if not all, commercially available golf clubs.

Figure 1:
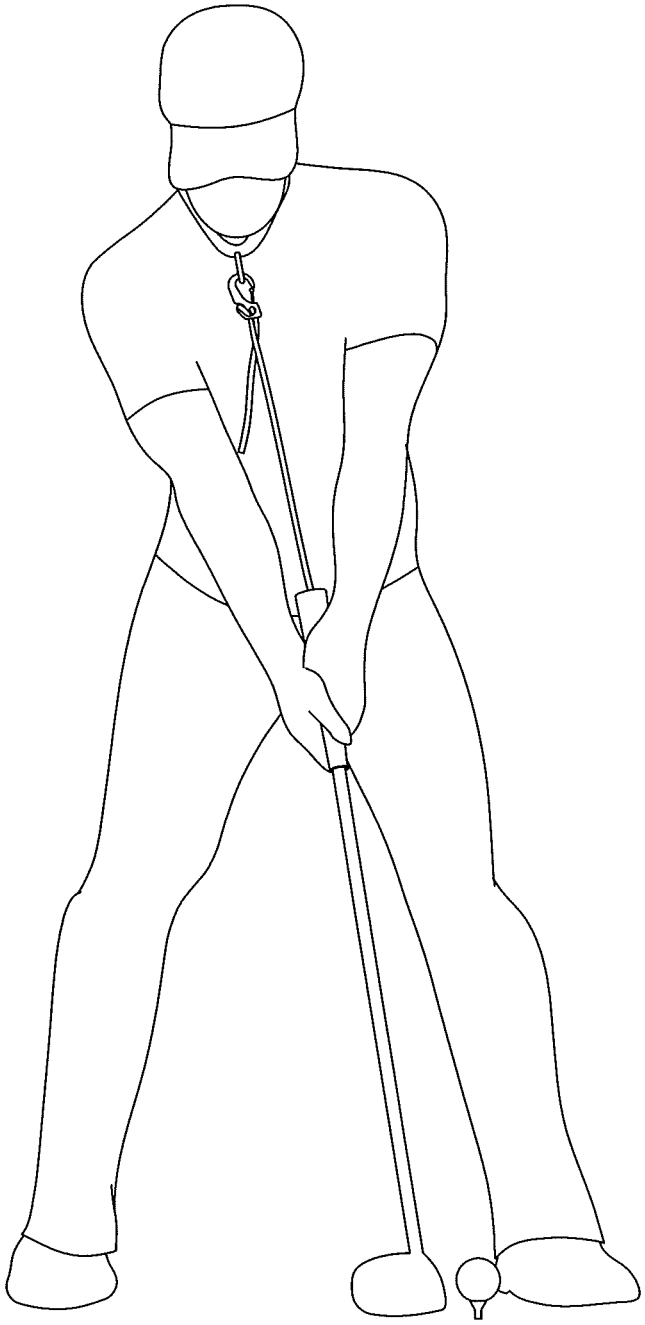
FIG. 1 illustrates a user utilizing the present invention in the address position.
Figure 7:
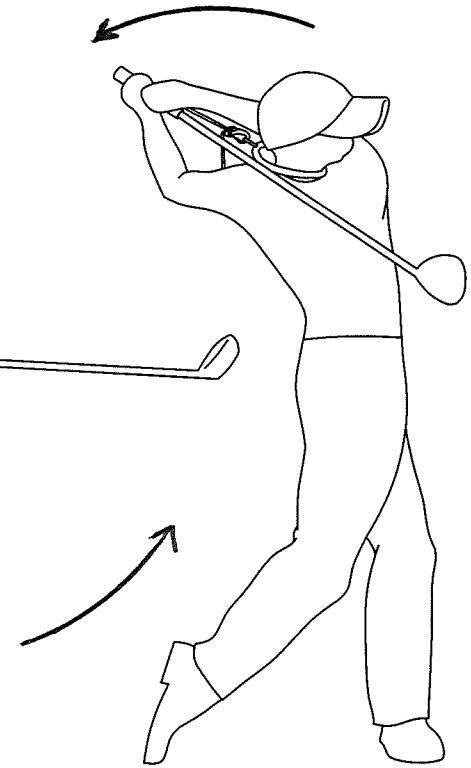
FIG. 7 illustrates a user utilizing the present invention in the finished position in balance.

FIG. 1 illustrates the preferred embodiment of the golf swing training and device of the present invention in place in a user's frame in the take away position. The training device is comprised of a neck collar (1) In the preferred embodiment of the invention, the collar is made of 600 gauge fleece, capable of being attached securely but comfortably (with about 1 inch of slack at the front of the neck in the preferred embodiment of the invention) around the user's neck. A "D" ring (or other receiving means) (3) is sewn into the middle of the collar. A 25" long by 1.5" wide collar works for all potential users. A 5" Velcro strip (or other attachment means) (2) is sewn into each end (14) of the collar to allow the ends of the collar to fasten securely. An adjustable plastic hook (or other engagement means) (4) is attached to the "D" ring (3) on the center (15) of the collar (1). A 30" piece of 6 mm bungee cord (or other feedback means) (5) is run through the adjustable hook (4) and attached securely to the engagement means. The hook (4) can securely attach itself to the bungee cord (5). The bungee cord (5) is fed through the outside of the vent hole (7) of the grip (6) until the cord extends out the other side of the grip. The bottom end (13) of the bungee cord (5) is crimped with a 6" galvanized hog ring and fed back up into the grip (6) until it is forced up into the inside end of the golf grip. The grip (6) is then affixed to the golf club shaft (8) using two-sided tape and a re-gripping solution. Use of the training device may be seen in FIGS. 1 through 7.

In alternative embodiments of the invention, the invention may also comprise a golf grip (6) or an entire golf club, including the golf club grip (6), golf club shaft (7) and golf club head (8).

Figure 8:
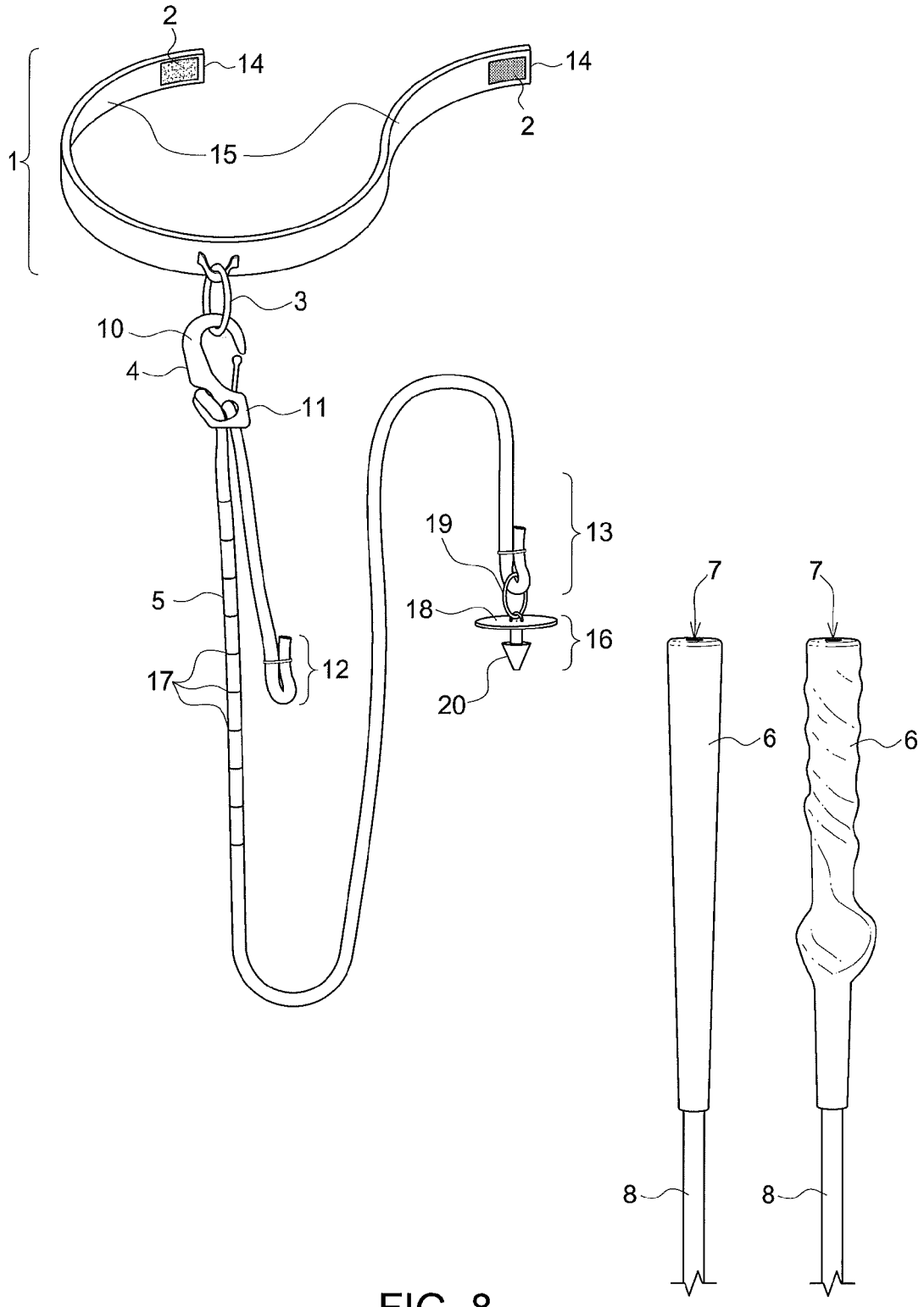
FIG. 8 illustrates the components of the preferred embodiment of the invention while not attached to a golf club grip or worn by a user with the inclusion of the optional anchor member for easy attachment to a golf club grip and depicting two prior art golf club grips: a training grip (right) and a standard grip (left).

An alternative embodiment depicted in FIG. 8 comprises the addition of an anchor member (16) to the bottom end of the feedback means (5), which facilitates the attachment of the device to a golf club grip (6). The anchor member has a flattened disc-like body (18) with a ring (19) protruding from the top and a cylindrical anchor portion (20) depending from the bottom. The bottom end (13) of the feedback means is looped through the ring (19) and secured. The anchor (20) begins with a narrow shaft and then expands to an enlarged conical head near the anchor member's body. The conical head terminates in a dull point. The anchor (20) can be inserted into the vent hole (7) of a golf club grip (6). The conical head of the anchor is of a sufficient diameter to resist being pulled out from the golf club grip by the tension exerted by the feedback means when the device is in use.

To begin using the device of this invention, the user takes each end (14) of the neck collar (1) in the left and right hand, respectively and places it around his or her neck. The collar is capable of being adjusted, loosened or tightened per the user's preference, via the collar's adjustable attachment means (2). To properly use the device of this invention, the user should adjust the collar's attachment means (2) so that the collar maintains about one inch of slack in the front end of the user's neck. The user then attaches the detachable engagement means (an adjustable plastic hook already attached to the feedback means in the preferred embodiment of the invention) (4) to the collar's receiving means (3). Next, the user can adjust the tension of the graduated feedback means (5) by holding a golf club's grip to which the graduated feedback means is attached (6), assuming an address position suitable to the user, and pulling the top end of the Bungee cord (5) until the user feels a moderate amount of tension on the back of the neck. While doing so, the user will also feel a moderate amount of tension in the hands when the golf club is grounded in the address position and the detachable engagement means (4) is properly attached to the graduated feedback means (5). If the user has not previously done so, the user can then record the number corresponding to the tension appropriate to the user's height, arm length and other physical attributes, if using an embodiment of the invention that includes a graduated feedback means.

The tension the user feels on the back of the neck promotes better stance and posture as it reminds the golfer to keep the flex in the spine, hips and knees and eliminate a common golf swing flaw of lifting the head or looking up too soon during the downswing.

The user is now ready to begin using the golf swing training and aid device of the present invention. To achieve optimal results, the user holds onto the grip (6), which can be a commercially available training grip which provides the correct hand and proper grip position, i.e., a neutral grip. The feedback the invention provides, combined with using a commercially available training grip, as depicted in FIG. 8, provides the required "feel" to allow the user to incorporate a proper position and pressure of the hands on the grip into his or her golf game in actual playing conditions.

Figure 5:
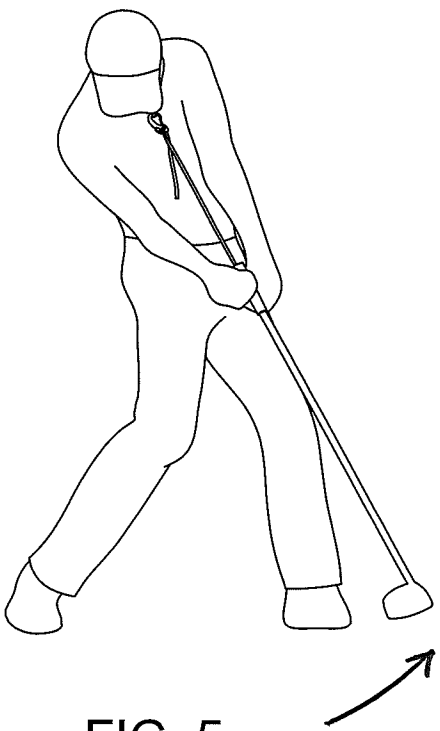
FIG. 5 illustrates a user utilizing the present invention immediately after impact between the golf club head and the ball.

As illustrated in FIG. 1, the feedback means at the address position is capable of forming a straight line from the user's chin to the sternum to the navel to the groin. The preferred angle of the feedback means is 180 degrees from the collar's receiving means (3) to the end of the grip (6). That tension position of the feedback means is then maintained throughout the entire swing. As the user begins his or her take away movement, hands, arms, shoulders and feedback means will move together away from the body, eliminating an ill-timed or disconnected take-away. The plane of the feedback means (5) has a natural tendency to stay in line with the center of the user's torso. By attempting to maintain the feedback means' constant tension through the backswing (FIG. 2) all the way to the top of the swing (FIG. 3), the apparatus of this invention promotes the reduction and, in most cases, the elimination of a flawed, shortened swing plane. Once the user's hands start dropping downward, he or she must maintain the feedback means (5) on a vertical plane and with constant tension all the way through the downswing (FIG. 4). Doing so greatly reduces or eliminates the most common swing flaw in golf—casting of the club with either the hands or right shoulder. At impact the user, while maintaining the constant tension and proper angle of the feedback means will achieve a maximized, strong impact position (FIG. 5). The proper use of the device of this invention also promotes a strong and straight left arm through the golf swing, thus reducing or eliminating the flawed "chicken wing" and overactive right hand or "scooping" of the club at impact. As the golfer maintains the feedback means' tension and angle, he or she will finish the swing at a tall and vertical position (FIGS. 6 and 7), reducing or eliminating a common golf swing flaw—quick inside or horizontal finish. Finally, while using the device with the feedback means (5) at a constant tension and angle, the user will likely stay in balance and prevent a common golf swing flaw—adjustment of the feet relative to the ball at impact or shortly thereafter to keep from falling forward.

In order to master the proper golf swing, the user should repeat his or her swing using the device of this invention over and over again. The user can swing the golf swing trainer and aid apparatus of this invention with or without hitting a golf ball.

What is claimed is:

1. A golf swing training and aid device capable of promoting the reduction or elimination numerous flaws in a golf swing by providing feedback to a user, the device comprising:

a. an ergonomically designed and fully adjustable neck collar capable of being attached securely but comfortably around a user's neck, the neck collar comprising two ends and a center portion;

b. an attachment means placed at the two ends of the neck collar and capable of securing the collar to the user's neck;

c. a receiving means firmly attached to the center portion of the neck collar;

d. a detachable engagement means comprising a engagement end and a receiving end, the engagement end capable of being detachably attached to the receiving means;

e. a feedback means capable of being firmly and detachably attached to the receiving end of the detachable engagement means, the feedback means comprising an elastic, resistant and adjustable elongated material capable of providing feedback to the user through manual and adjustable tension, the feedback means further comprising a top end and a bottom end, the top end being capable of attachment to the receiving end of the detachable engagement means; and the feedback means being capable of being securely inserted through a vent hole commonly found in commercial golf club grips.

2. The golf swing training and aid device capable of promoting the reduction or elimination numerous flaws in a golf swing by providing feedback to a user of claim 1, wherein the device additionally comprises a golf club grip which is securely attached to the feedback means.

3. The golf swing training and aid device capable of promoting the reduction or elimination numerous flaws in a golf swing by providing feedback to a user of claim 1, wherein the device additionally comprises a golf club, the golf club comprising a golf club grip, a golf club shaft and a golf club head, and wherein the feedback means is securely attached to the golf club grip.

4. The golf swing training and aid device capable of promoting the reduction or elimination numerous flaws in a golf swing by providing feedback to a user of claim 1, wherein the neck collar comprises a 25 inch long by 1.5 inch wide belt-shaped device fabricated from material sufficiently recilient and flexible to allow the user to place the neck collar comfortably secured to the user's neck while using the device.

5. The golf swing training and aid device capable of promoting the reduction or elimination numerous flaws in a golf swing by providing feedback to a user of claim 1, wherein the neck collar's attachment means is selected from the group consisting of one or more hooks, clasps, fasteners, snaps, rivets, binders, clamps and clips; a buckle and buckle ring system, a zipper, a Velcro® fastening system, a buttons and eyes combination and a magnetic fastening system.

6. The golf swing training and aid device capable of promoting the reduction or elimination numerous flaws in a golf swing by providing feedback to a user of claim 1, wherein the neck collar's receiving means is selected from the group consisting of D-ring, carabiner, grommet, loop and O-ring.

7. The golf swing training and aid device capable of promoting the reduction or elimination numerous flaws in a golf swing by providing feedback to a user of claim 1, wherein the engagement means is selected from the group consisting of hook, carabiner, snap hook, swivel snap, bolt snap, cam buckle, spring buckle and ratchet buckle.

8. The golf swing training and aid device capable of promoting the reduction or elimination numerous flaws in a golf swing by providing feedback to a user of claim 1, wherein the feedback means comprises a 30 inch long by 6 mm in diameter commercially available bungee cord.

9. The golf swing training and aid device capable of promoting the reduction or elimination numerous flaws in a golf swing by providing feedback to a user of claim 1, wherein the bottom end of the feedback means is capable of being crimped with a 6" galvanized hog ring and fed back up into the vent hole of the grip until it is securely attached to the top end of the golf club grip.

10. The golf swing training and aid device capable of promoting the reduction or elimination numerous flaws in a golf swing by providing feedback to a user of claim 1, wherein the device further comprises an anchor member, the anchor member comprising a flattened disc-like body portion, a ring portion and a cylindrical anchor portion, the body having a top side and a bottom side, the ring extending upward from the top side, the anchor depending from the bottom side, the ring being capable of engaging the bottom end of the feedback means, the anchor comprising a shaft and terminating in an enlarged conical head and terminating in a point farthest from the body, the anchor being capable of being inserted into the vent hole of a golf club grip and resisting the tension exerted by the feedback means without becoming dislodged from the vent hole.

11. The golf swing training and aid device capable of promoting the reduction or elimination numerous flaws in a golf swing by providing feedback to a user of claim 1, wherein the feedback means is graduated and further comprising a surface capable of receiving a printed or attachable scale system, the scale system comprising numbers or letters, and capable of being secured at different levels through the receiving end so that each user can ascertain the number or letter in the graduated feedback means that provides maximum feedback and can easily reset the feedback means to that number or letter.

12. A golf swing training and aid device capable of promoting the reduction or elimination numerous flaws in a golf swing by providing feedback to a user, the device comprising:

a. an ergonomically designed and fully adjustable neck collar capable of being attached securely but comfortably around a user's neck, the neck collar comprising two ends and a center portion;

b. an attachment means placed at the two ends of the neck collar and capable of securing the collar to the user's neck, wherein the attachment means is selected from the group consisting of one or more hooks, clasps, fasteners, snaps, rivets, binders, clamps and clips; a buckle and buckle ring system, a zipper, a Velcro® fastening system, a button and eye combination and a magnetic fastening system;

c. a receiving means firmly attached to the center portion of the neck collar, wherein the receiving means is selected from the group consisting of D-ring, carabiner, grommet, loop and O-ring;

d. a detachable engagement means, comprising a engagement end and a receiving end, the engagement end capable of being detachably attached to the receiving means through its engagement end, wherein the engagement means is selected from the group consisting of hook, carabiner, snap hook, swivel snap, bolt snap, cam buckle, spring buckle and ratchet buckle;

e. a graduated feedback means capable of being firmly and detachably attached to the receiving end of the detachable engagement means, the feedback means comprising an elastic, resistant and adjustable bungee cord capable of providing feedback to the user through manual and adjustable tension, the feedback means further comprising a surface capable of receiving a printed or attachable scale system, the scale system comprising numbers or letters, and capable of being secured at different levels through the receiving end so that each user can ascertain the number or letter in the graduated feedback means that provides maximum feedback, the feedback means further comprising top end and a bottom end, the top end being attachable to the receiving end of the detachable engagement means;

f. a golf club grip comprising a vent hole, the vent hole being capable of receiving the feedback means;

g. a golf club shaft comprising a top end and a bottom end, the top end being capable of securely and firmly receiving the golf club grip;

h. a golf club head capable of being firmly and securely attached to the bottom end of the golf club shaft.

13. A method of using the golf swing training and aid device capable of promoting the reduction or elimination numerous flaws in a golf swing by providing feedback to a user comprising the steps of:

a. placing a neck collar around the user's neck;

b. fastening the neck collar using an attachment means in such a way as to leave approximately 1 inch of slack between a center portion of the neck collar and the user's neck;

c. attaching a detachable engagement means to the collar's adjustable attachment means, the detachable engagement means being secured to a graduated feedback means, and the graduated feedback means being attached to a golf club's grip through the golf club grip's vent hole;

d. adjusting the tension of the graduated feedback means by holding the golf club grip, assuming an address position suitable to the user, and extending the graduated feedback means until the user feels a moderate amount of tension on the back of the neck and a moderate amount of tension in the user's hands when the golf club is grounded in the address position;

e. recording the number or letter from the graduated feedback means corresponding to the tension appropriate to the user's height, arm length and other physical attributes;

f. allowing tension the user feels on the back of the neck to promote appropriate stance and posture as it reminds the golfer to keep flex in the spine, hips and knees and to eliminate a common golf swing flaw of lifting the head or looking up too soon during the downswing;

g. holding onto the golf club grip, which can be a commercially available training grip which provides the correct hand and proper grip position, i.e., a neutral grip;

h. allowing the device to provide the required feel to the user resulting in a proper position and pressure of the user's hands on the golf club grip;

i. aligning the feedback means at an address position to form a straight line extending from the user's chin to the sternum to the navel to the groin with the preferred angle of the feedback means being 180 degrees from the neck collar's receiving means to the end of the golf club grip;

j. swinging while maintaining the tension of the feedback means throughout the entire swing while allowing the user's hands, arms, shoulders and feedback means to move together away from the body eliminating an ill-timed or disconnected take-away;

k. allowing the feedback means to stay aligned with the center of the user's torso while maintaining the feedback means' tension constant through the user's backswing, all the way to the top of the swing so as to allow the device to the reduction and, in most cases, the elimination of a flawed, shortened swing plane;

l. allowing the user's hands to drop down while maintaining the feedback means on a vertical plane and on a constant tension all the way through the user's downswing movement so as to allow the device to reduce or eliminate a common golf swing flaw comprising casting of the club with either the user's hands or right shoulder;

m. maintaining the feedback means' constant tension and proper angle through impact so as to allow a maximized, strong impact position, promote a strong and straight left arm through the golf swing, thus reducing or eliminating the flawed golf swing effect knows as chicken wing and an overactive right hand or scooping of the golf club at impact;

n. further maintaining the feedback means' tension and angle constant so the user is capable of finishing the golf swing at a tall and vertical position, reducing or eliminating a common golf swing flaw known as quick inside or horizontal finish;

o. further maintaining the feedback means at a constant tension and angle so as to allow the user to remain in balance thus preventing a common golf swing flaw comprising an adjustment of the user's feet relative to the golf ball at impact or shortly thereafter and to prevent the user from shifting his body forward; and p. repeating the golf swing using the device of this invention with or without actually hitting a golf ball.

* * * * *